US005676608A

United States Patent [19]

Christian et al.

[11] Patent Number: 5,676,608

[45] Date of Patent: Oct. 14, 1997

[54] HOCKEY STICK BLADE AND METHOD OF MAKING THE SAME

[75] Inventors: William D. Christian; Roger A. Christian, both of Warroad, Minn.

[73] Assignee: Christian Brothers, Inc., Warroad, Minn.

[21] Appl. No.: 620,042

[22] Filed: Mar. 21, 1996

Related U.S. Application Data

[60] Provisional application No. 60/011,825, Feb. 16, 1996.

[51] Int. Cl.[6] ..... A63B 59/12

[52] U.S. Cl. ..... 473/563

[58] Field of Search ..... 273/67 A

[56] References Cited

U.S. PATENT DOCUMENTS

| | | | |
|---|---|---|---|
| 1,601,116 | 9/1926 | Hall | 273/67 A |
| 1,821,889 | 9/1931 | Glahe . | |
| 2,260,218 | 10/1941 | Evernden . | |
| 3,529,825 | 9/1970 | White, Sr. . | |
| 3,982,760 | 9/1976 | Tiitola . | |
| 4,059,269 | 11/1977 | Tiitola . | |
| 4,134,587 | 1/1979 | Diederich . | |
| 4,172,594 | 10/1979 | Diederich . | |
| 5,160,135 | 11/1992 | Hasegawa | 273/67 A |
| 5,294,113 | 3/1994 | Ladouceur et al. . | |
| 5,407,195 | 4/1995 | Tiitola et al. | 273/67 A |

FOREIGN PATENT DOCUMENTS

| | | | |
|---|---|---|---|
| 1207350 | 7/1986 | Canada | 273/67 A |
| 3238117 | 6/1983 | Germany | 273/67 A |

*Primary Examiner*—Mark S. Graham
*Attorney, Agent, or Firm*—Dorsey & Whitney LLP

[57] ABSTRACT

A wooden hockey stick blade having a slot formed in its bottom edge and a wear strip disposed within the slot and extending along its bottom edge. The invention also involves a method of making a hockey stick blade by forming a slot in a bottom portion of the blade woodstock and disposing a strip of wear resistant material in the slot.

21 Claims, 3 Drawing Sheets

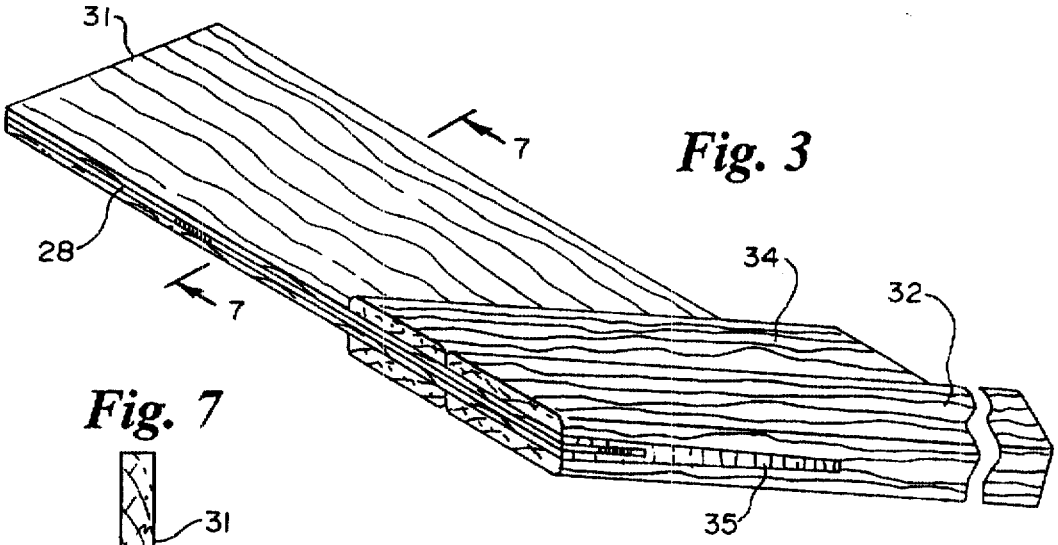
Fig. 3
Fig. 7
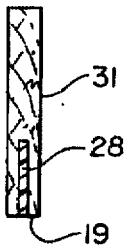
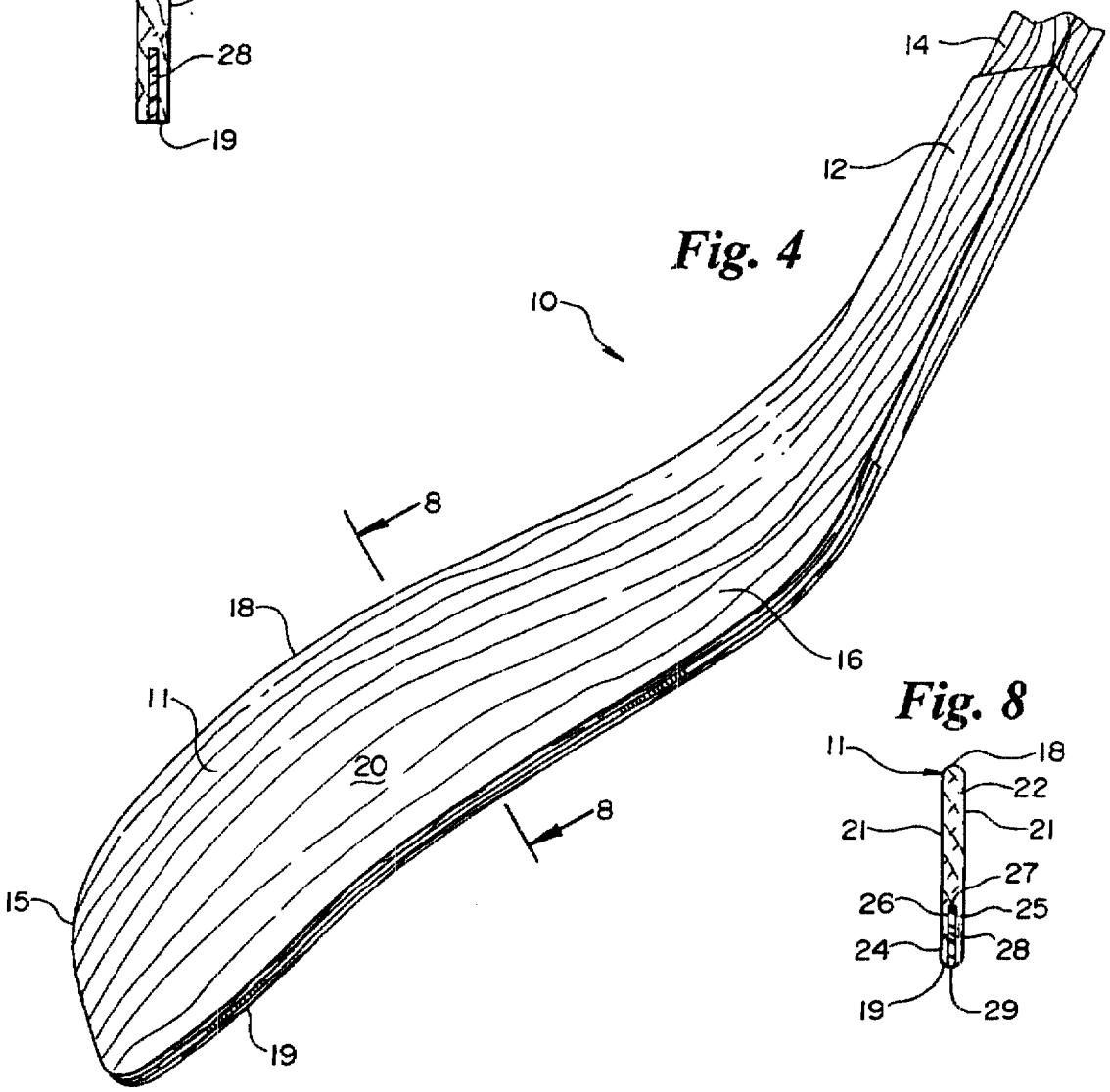
Fig. 4
Fig. 8

HOCKEY STICK BLADE AND METHOD OF MAKING THE SAME

This application claims the benefit of U.S. provisional application Ser. No. 60/011,825 filed Feb. 16, 1996.

BACKGROUND OF THE INVENTION

1. Field of the Invention

The present invention relates generally to a hockey stick blade and method of making the same, and more particularly, to a wooden hockey stick blade having a plastic wear bead or strip along its bottom edge and a method for making the same.

2. Description of the Prior Art

Hockey sticks have experienced dramatic changes throughout the years. For example, ice hockey sticks have evolved from a plain wooden stick having a straight blade and handle to a significantly improved stick having a curved blade and being reinforced with fiberglass or the like. Significant evolution has also occurred in construction of the stick itself from sticks in which the handle and blade portions were both constructed of wood and were joined with one another through various processes to form a single, integral unit, to sticks having separate handles constructed of aluminum or composite plastic for use with replaceable wooden or plastic blades.

Historically, wooden blades have been reinforced with fiberglass or the like to extend the life of the blade and to prevent the same from prematurely cracking, splitting or breaking. It is also conventional to wrap wooden blades with friction tape to assist in protecting the blade from wear and breakage and to also provide the blade with a frictional surface for better puck control. However, despite the existence of fiberglass reinforcement and friction tape wrapping, the bottom edge of wooden hockey stick blades continues to be the part which is subject to the greatest wear. This is due primarily to the impact of the bottom edge against the ice during slap shots, etc. and the almost continuous sliding contact between the bottom edge and the ice surface during play.

Further, as the friction tape and fiberglass reinforcement wear away from the bottom edge, wood fibers along the bottom edge are exposed to the moisture and dampness of the ice surface. This causes deterioration of such wood fibers and further weakening of the blade along its bottom edge.

Recently various plastic or composite blades have been introduced. Although some of these plastic blades exhibit improved wear resistance over wooden blades, wooden blades continue to be the overwhelming blade of choice for ice hockey.

Further, wooden ice hockey sticks are commonly used in connection with ball hockey and street hockey which are commonly played on concrete or asphalt surfaces. These surfaces cause wooden sticks to rapidly wear away to the point where they are too thin to be effectively used in playing ice hockey, thereby eventually ruining the stick.

Accordingly, there has been a continuing need for a hockey stick with means for improving the wear resistance along the bottom edge.

Several prior patents have recognized the problem of hockey stick blade wear, including bottom edge wear, and have proposed solutions to it. For example, U.S. Pat. No. 4,059,269 issued to Tiitola discloses a non-wooden hockey stick blade in which the entire core body is made of a thermoplastic wear resistant material. The core is then laminated on both sides, first with a layer of a plastic material and then with a wood veneer.

U.S. Pat. No. 3,982,760 issued to Tiitola also discloses a hockey stick blade having a central core which is laminated first with a pair of reinforcing plastic layers and finally by a pair of protective wood veneer layers. The core is made up of a plurality of pieces, a central core piece of a wooden material, an upper core piece of a wooden material different than the central core piece and a lower core piece constructed of a wear resistant plastic material.

U.S. Pat. No. 5,294,113 issued to Ladouceur et al. relates to a protector for a hockey stick blade. The device includes a selectively removable protective piece held to the blade by tape or the like which protects the bottom edge of the blade when the blade is used on concrete, asphalt or similar surfaces other than ice.

U.S. Pat. No. 5,407,195 relates to a composite, non-wooden hockey stick blade construction with a wear resistant member along its bottom edge.

Notwithstanding the prior art described above, a need continues to exist for a wooden hockey stick blade having a means for substantially reducing the wear along the bottom edge, and thereby increasing the life of the blade. A need also exists for a method of making such a blade.

SUMMARY OF THE INVENTION

In contrast to the prior art, the present invention relates generally to a wooden hockey stick blade having a plastic wear bead or wear strip along the bottom edge and a method for making the same. The blade is constructed substantially of wood and has a toe end, a heel end and top and bottom edges. The wooden blade is provided with an elongated slot or groove along the bottom edge which extends upwardly toward the top edge and between the sides of the blade throughout its entire length. The blade also includes an elongated strip of wear resistant plastic such as an epoxy reinforcing compound disposed within the slot between the blade sides so that a bottom portion of the wear resistant strip coincides with and defines at least a portion of the bottom edge of the blade.

The process of the present invention includes providing a blade woodstock and sawing, routing or otherwise forming a narrow slot or groove along the bottom edge of the woodstock such that the recessed area extends upwardly from the bottom edge toward the top edge and between side portions of the blade. The slot or groove is then filled with a strip of wear resistant material. Preferably, this strip of material is introduced into the slot in a flowable form as an uncured resin or a melted plastic and then allowed to cure or solidify to its hardened form. Alternatively, a plastic wear strip of wear resistant material can be preformed and then inserted into the slot and retained therein by an appropriate adhesive or the like. Following either process, the stick is then assembled in accordance with conventional techniques by connecting the blade with the handle connection elements and by shaping, sanding and curving the blade. The resulting blade may be further reinforced with fiberglass or the like in accordance with conventional techniques.

Accordingly, it is an object of the present invention to provide a wooden hockey stick blade having improved means for enhancing the life of the blade.

Another object of the present invention is to provide a substantially wooden hockey stick blade having a plastic wear bead or strip along its bottom edge.

A further object of the present invention is to provide a method for making a wooden hockey stick blade with improved wear resistant means along its bottom edge.

These and other objects of the present invention will become apparent with reference to the drawings, a description of the preferred embodiment and the appended claims.

DESCRIPTION OF THE DRAWINGS

FIG. 3 is an isometric view of a further stage of manufacture of the blade of the present invention.

FIG. 4 is an isometric view of a finished blade in accordance with the present invention.

FIG. 7 is a sectional view as viewed along the section line 7—7 of FIG. 3.

FIG. 8 is a sectional view as viewed along the section line 8—8 of FIG. 4.

DESCRIPTION OF THE PREFERRED EMBODIMENT AND METHOD

Figure 1:
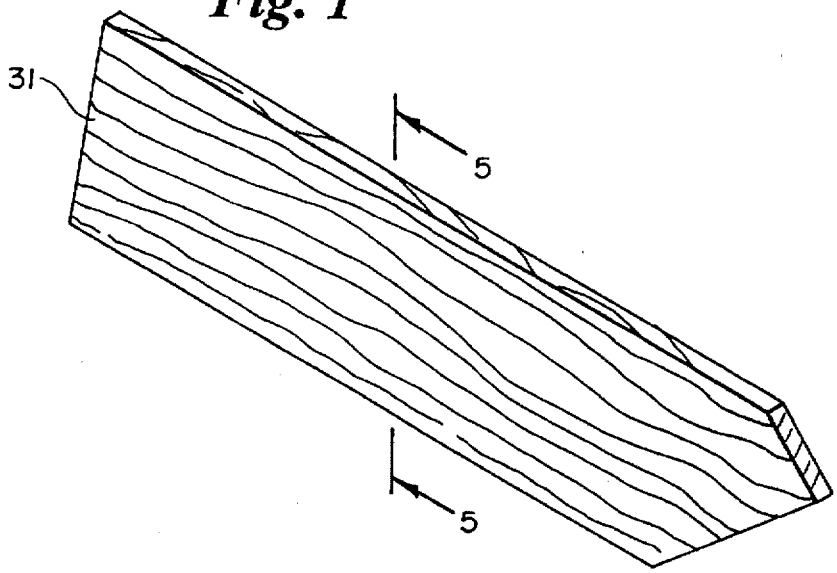
FIG. 1 is an isometric view of a piece of woodstock from which the blade of the present invention is made.

The hockey stick blade of the present invention is illustrated in its finished form in the isometric view of FIG. 4 by the reference character 10. In the preferred embodiment the blade 10 is shown as a replacement blade sold separately and designed for connection with an aluminum or composite shaft in accordance with techniques known in the art. It is also contemplated, however, that the blade of the present invention can be integrally joined with a wooden shaft (such as is shown in FIG. 3) in accordance with techniques common in the art and sold as a single unit. The present invention is also applicable to, and can be used in connection with the manufacture of, a goaltender's stick.

As shown best in the isometric view of FIG. 4 and the sectional view of FIG. 8, the blade 10 includes a blade portion 11 and a handle connecting portion 12. The handle connecting portion 12 integrally joined at its lower end with the blade portion 11. In the embodiment of FIG. 4, the top end of the handle connecting portion 12 includes a connecting tenon 14 for connection with an aluminum or composite hockey stick handle (not shown) in accordance with techniques known in the art. The blade portion 11 includes a toe end 15, a heel end 16, a top edge 18, a bottom edge 19 and front and back sides or faces 20 and 21, respectively. The blade portion 11 has a length dimension defined by the distance from the toe end 15 to the heel end 16, a height dimension defined by the distance from the toe end 15 to the heel end 16, a height dimension defined by the distance from the bottom edge 19 to the top edge 18 and a width dimension defined by the distance between the sides 20 and 21.

As illustrated best in the sectional view of FIG. 8, the blade portion 11 includes a main core or body 22 constructed entirely of wood. The lower portion of the body 22 is provided with an elongated slot or groove 26. As shown in both FIGS. 4 and 8, the slot 26 is formed between the sides or faces 20 and 21 and extends substantially throughout the entire length of the blade portion 11 from the toe end 15 to the heel end 16. The slot 26 opens toward the bottom edge 19 and has a depth dimension extending from the bottom edge toward the top edge 18. The innermost edge of the slot 26 is defined by the inner edge 27. Preferably, the depth of the slot is greater than about 10%, more preferably greater than about 20% and most preferably greater than about 25% of the blade height.

Figure 6:
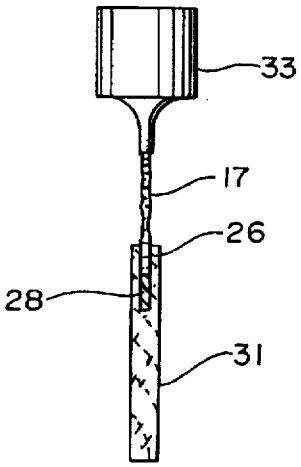
FIG. 6 is a sectional view as viewed along the section line 6—6 of FIG. 2.

The blade of the present invention also includes an elongated wear bead or wear strip provided along the bottom edge 19. This wear bead or wear strip comprises an elongated strip 28 of wear resistent material which is inserted into or disposed within slot 26 as shown in FIGS. 6, 7 and 8 or the alternate embodiment of FIG. 10. The dimensions of the elongated strip 28 conform to the dimensions of the slot 26 so that the bottom edge 29 of the wear strip 28 will form a portion of the bottom edge 19 and the outer sides and top edge of the strip 28 will engage with the sides and inner edge of the slot 26.

Figure 9:
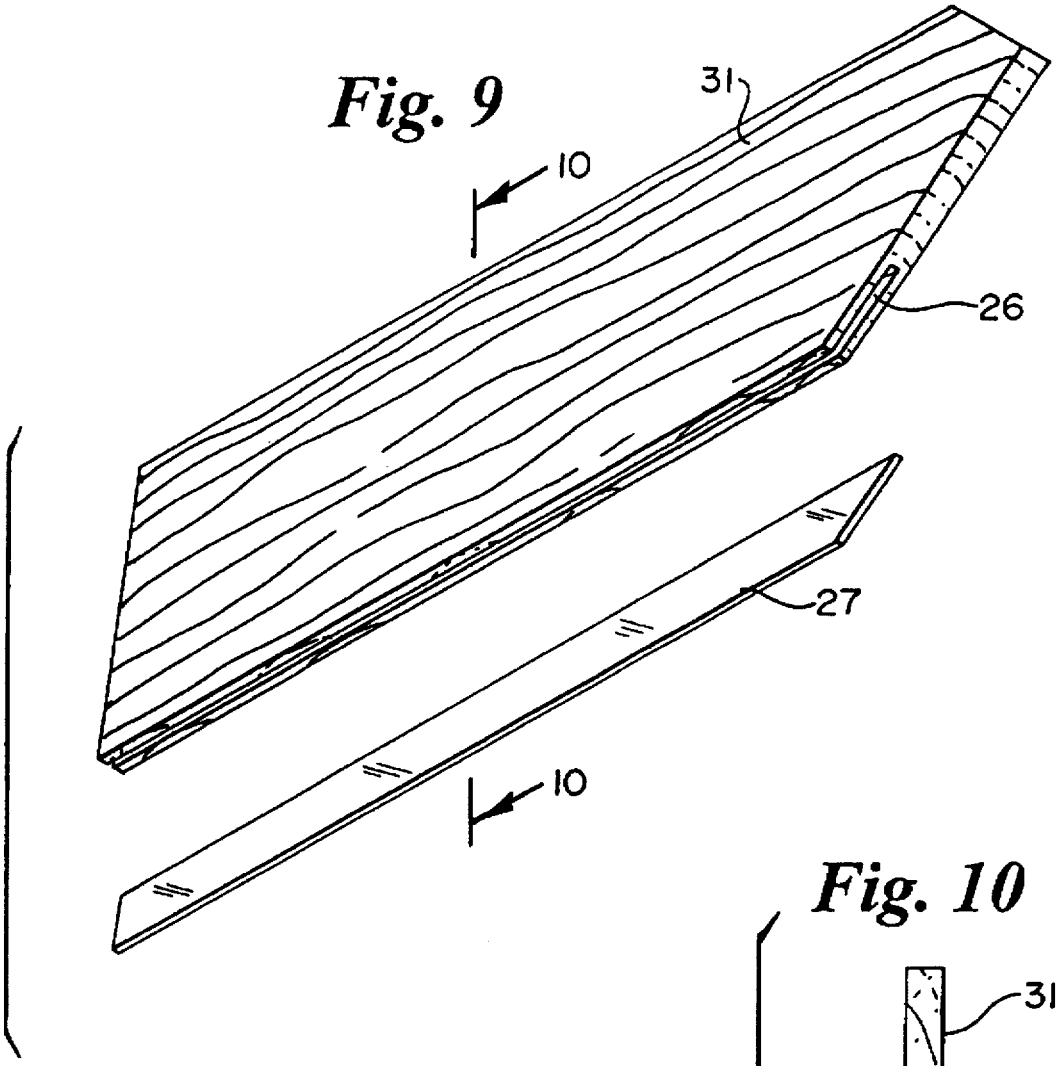
FIG. 9 is an isometric view of an alternative step for providing the slotted woodstock with a strip of wear resistant material.
Figure 10:
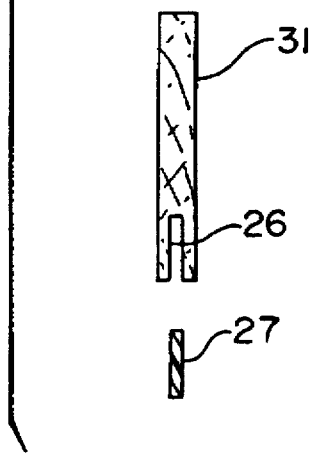
FIG. 10 is a sectional view as viewed along the section line 10—10 of FIG. 9.

The wear strip 28 is preferably introduced into the slot 26 by pouring or otherwise inserting an uncured resin or a molten plastic material in a flowable form into the slot 26. Thereafter, the resin or other material is allowed to cure or harden to the desired hardness within the slot 26. In the preferred embodiment, the wear strip 28 is a plastic wear resistant material such as an epoxy reinforcing compound of a type commercially available. Alternatively, the strip 28 can be precut from a stock of wear resistant material and inserted into the slot 26 as shown in FIGS. 9 and 10. In this alternate embodiment, the strip is retained with an appropriate adhesive.

In the structure of the finished blade as shown in FIGS. 4 and 8, a portion of the body 22 extends downwardly toward the bottom edge 19 on both sides of the wear strip 28 in the form of the side body portions 24 and 25 to define the slot 26. Thus, in a preferred embodiment, the portions 24 and 25 are formed as an integral part of the body 22 and are thus constructed of the same wooden material as the portion of the blade above the slot. Further, the bottom edges of the portions 24 and 25, together with the bottom edge of the strip 28, form the bottom edge 19 of the blade.

Having described the structure of the preferred embodiment, the preferred method of making the blade in accordance with the present invention can best be understood with reference to FIGS. 1–4 and 5–8. These figures reflect the method of the present invention and show the sequence of the manufacturing process in making the blade of the present invention. The first step is to cut or otherwise provide a woodstock 31 as shown in FIG. 1. This step is similar to conventional stick making techniques known in the art.

Figure 2:
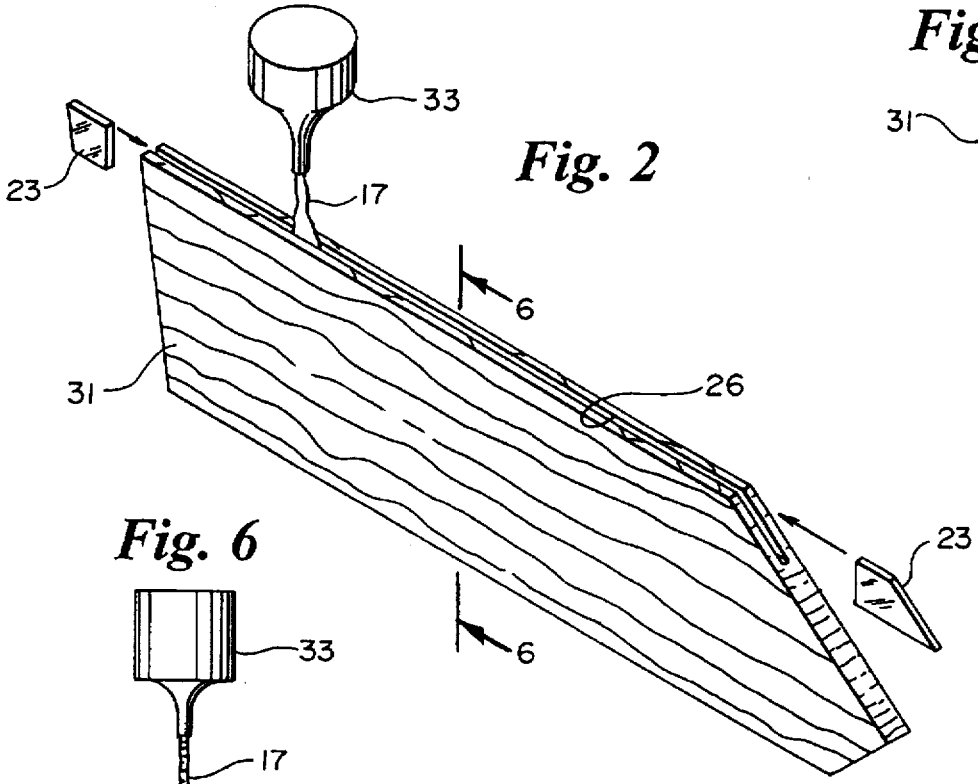
FIG. 2 is an isometric view of an intermediate step in the manufacture of the blade in accordance with the present invention showing the step of introducing a flowable form of a wear resistant material into the grooved woodstock.
Figure 5:
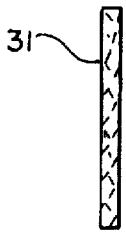
FIG. 5 is sectional view as viewed along the section line 5—5 of FIG. 1.

Next, an elongated slot or groove 26 is formed in an edge of the wood stock 31 which will ultimately form the bottom edge 19 of the blade 10. This slot 26 may be formed by any of a variety of techniques known in the art such as by cutting the slot 26 with a sawblade, a dado blade, a router or the like. A plastic wear strip 28 is also provided in the slot 26. Preferably, as shown in FIGS. 2 and 6, the strip 28 is provided in the lot 26 by pouring or otherwise introducing a precured resin in a flowable form into the slot 26 and then allowing the same to cure to its desired hardness. The uncured resin 17 can be introduced into the slot 26 by any conventional means such as via the dispenser 33 shown in FIGS. 2 and 6. Other dispensing means can, however, be used. In the preferred method, the resin 17 is a two part epoxy resin which, when uncured is capable of being introduced into the slot 26 in flowable form. To prevent the uncured resin from flowing out the ends of the slot 26, a pair of end stops 23,23 are provided. Alternatively, the slot 26 can be formed so that it does not extend completely to the woodstock ends. In either event, the woodstock with the inserted strip 28 can be trimmed prior to connection to the handle members as shown in FIGS. 3 and 7. Preferably the wear resistant material and specifically the resin which cures to form the strip 28 is a commercially available epoxy reinforcing compound. Other wear resistant materials can, however, be used as well.

Next, the woodstock 31 with the wear strip 28 is connected with the handle connecting members 32 and 34 in accordance with techniques that are common in the art. Such techniques are well known and are accordingly, incorporated by reference into the present disclosure. Such techniques may include forming elongated slots 35 in the members 32 and 34 and concerting one end of the woodstock 31 into such slots 35. In some cases, the outer surfaces of the woodstock 31 may be sanded or shaped for appropriate insertion and retention within the groove or slot 35. The woodstock 31 is retained relative to the members 32 and 34 by an appropriate adhesive.

Finally, the blade is finished to the configuration illustrated in FIG. 4 by shaping and sanding the excess portions of the woodstock 31 and members 32 and 34. The upper end of the element 32 is also shaped to form the tenon 14 (FIG. 4). If the blade 10 is to be formed integrally with a wooden handle, such techniques are known in the art.

Following the shaping and sanding operation, the blade 10 will exhibit the substantially finished configuration shown in FIG. 4. Additional conventional techniques may also be utilized for reinforcing the blade and improving its wear resistance including such things as wrapping or otherwise reinforcing the blade with fiber glass or the like.

As an alternative to the step shown in FIGS. 2 and 6, the strip 28 can be precut or preformed from a stock of wear resistant material and then inserted into the slot 26 in its hardened form as shown in FIGS. 9 and 10. With this embodiment, the strip is retained in the slot 26 via adhesive or the like.

Although the description of the preferred embodiment and method has been quite specific, it is contemplated that various modifications could be made without deviating from the spirit of the present invention. Accordingly, it is intended that the present invention be dictated by the appended claims rather then by the description of the preferred embodiment and method.

We claim:

1. A wooden hockey stick blade comprising:

a wooden body having a wooden blade portion including a toe end, a heel end, top and bottom edges and front and back sides;

an elongated slot formed in said wooden blade portion between said front and back sides, said slot being open to and extending along said bottom edge between said toe end and said heel end and having a depth extending from said bottom edge toward said top edge, said wooden blade portion including a wooden side portion on each side of and defining said slot and a wooden top portion between said slot and said top edge; and an elongated strip of wear resistant material disposed within said elongated slot, each of said side portions including a lower edge portion which, together with a portion of said elongated strip form said bottom edge as a continuous, uninterrupted surface extending between said front and back sides.

2. The hockey stick blade of claim 1 wherein said blade portion has a height dimension defined by the distance between said top and bottom edges and wherein said slot depth is greater than about 10% of said blade portion height.

3. The hockey stick blade of claim 2 wherein said slot depth is greater than about 20% of said blade portion height.

4. The hockey stick blade of claim 1 wherein said slot extends substantially the entire length of said blade portion from said heel end to said toe end.

5. The hockey stick blade of claim 1 wherein said wear resistant material is an epoxy material.

6. The hockey stick blade of claim 1 wherein said body includes a handle connecting portion.

7. The hockey stick blade of claim 1 in combination with a hockey stick handle.

8. The hockey stick blade of claim 1 wherein said wooden blade portion comprises a single piece of wood.

9. The hockey stick blade of claim 1 wherein said elongated strip is a wear resistent plastic material.

10. The hockey stick blade of claim 1 wherein said slot includes substantially parallel, spaced side walls.

11. A method of making a wooden hockey stick blade comprising the steps of:

providing a blade woodstock having a woodstock toe end, a woodstock heel end, a woodstock top edge and a woodstock bottom edge;

removing a portion of said blade woodstock along said woodstock bottom edge to form an elongated slot in said woodstock bottom edge between said woodstock toe end and said woodstock heel end wherein said slot includes a pair of opposed wooden side walls facing one another and said blade woodstock including a wooden side portion on each side of said slot to define said side walls and a wooden top portion between said slot and said woodstock top edge;

disposing an elongated strip of a wear resistant material in said slot; and forming said blade woodstock, with said strip disposed in said slot, to a desired size and configuration of a hockey stick blade having a blade toe end, a blade heel end, blade top and bottom edges and blade front and back sides, wherein said bottom edge is a continuous, uninterrupted surface extending between said front and back sides and said bottom edge is comprised of a portion of said blade woodstock side portions and a portion of said strip.

12. The method of claim 11 including connecting said blade woodstock to a handle portion.

13. The method of claim 11 wherein said step of forming said blade woodstock includes shaping and sanding.

14. The method of claim 11 wherein said woodstock includes a height dimension and wherein said step of forming an elongated slot includes forming said slot to a depth greater than about 10% of said woodstock height.

15. The method of claim 14 wherein said slot depth is greater than about 20% of said woodstock height.

16. The method of claim 11 wherein said disposing step includes introducing a flowable form of a wear resistant material into said slot and allowing said wear resistant material to harden.

17. The method of claim 16 wherein said flowable form of a wear resistant material is an uncured resin and after introduction includes the step of curing said resin.

18. The method of claim 11 wherein said disposing step includes inserting a preformed strip of wear resistant material into said slot.

19. The method of claim 11 wherein said blade woodstock is a single piece of wood.

20. The method of claim 16 wherein said woodstock includes a height dimension and wherein said step of forming an elongated slot includes forming said slot to a depth greater than about 10% of said woodstock height.

21. The method of claim 11 wherein said step of forming said elongated slot includes cutting said slot.

* * * * *